US005135616A

United States Patent [19]

Nicholson et al.

[11] Patent Number: 5,135,616

[45] Date of Patent: Aug. 4, 1992

[54] OIL PURIFICATION

[75] Inventors: David Nicholson, Aldridge; John M. Forester, West Heath, both of England

[73] Assignee: Wellman Furnaces Limited, England

[21] Appl. No.: 402,785

[22] Filed: Sep. 5, 1989

[30] Foreign Application Priority Data

Sep. 13, 1988 [GB] United Kingdom ..... 8821399

[51] Int. Cl.[5] ..... B01D 3/38; B01J 8/02

[52] U.S. Cl. ..... 196/46; 196/127; 210/266; 210/296; 210/322; 422/187; 422/190; 422/199

[58] Field of Search ..... 422/187, 189, 190, 199, 422/211, 257, 260; 210/265, 266, 294, 296, 322; 196/46, 98, 127

[56] References Cited

U.S. PATENT DOCUMENTS

| | | | |
|---|---|---|---|
| 2,061,666 | 11/1936 | Miller | 196/127 X |
| 3,689,226 | 9/1972 | Stoddard | 210/265 X |
| 4,046,743 | 9/1983 | MacQueen et al. | 196/46 |
| 4,452,671 | 6/1984 | Oakes | 210/294 X |

FOREIGN PATENT DOCUMENTS 2178834 2/1987 United Kingdom .

*Primary Examiner*—Jill Johnston

*Attorney, Agent, or Firm*—Learman & McCulloch

[57] ABSTRACT

Apparatus for oil purification comprises a packed column for contacting sour oil with steam from a boiler, a gravity separator for separating the oil and water, a coalescer for coalescing the recovered oil, and a condenser for separating the lighter fraction from the column.

7 Claims, 2 Drawing Sheets

OIL PURIFICATION

BACKGROUND OF THE INVENTION

This invention relates to a process for oil purification and also to apparatus for this purpose. The kind of purification which is concerned is for example the removal of contaminants resulting from use of the oil in centrifugal pumps and compressors which are used for hydrocarbons especially at oil and gas production points. The compressor oil then becomes contaminated by entraining the produced hydro-carbons and/or by carbon dioxide, hydrogen sulphide and water soluble contaminants.

A typical compressor may have a requirement of 100–150 liters per day. There is therefore a need for an economic purification system enabling recovery or recycling of the oil.

A known solution involves air or vacuum treatment but requires an expensive plant with major running costs and consequently the economics of this, especially for use at offshore platforms is marginal.

Attempts have been made to produce a relatively inexpensive plant based on steam distillation at atmospheric pressure for example according to patent GB 2 178 834A, but it is believed that this has not proved to be practical.

The object of the invention is to solve the problem.

SUMMARY OF THE INVENTION

According to the invention a process for oil purification comprises contacting the sour oil with steam in a packed column, collecting heavier mixture gravity discharge from the column and gravity separating the same into sweet oil and water fractions, passing the sweet oil fraction through a coalescer, and collecting the lighter mixture discharged from the top of the column and condensing and separating the same into water and contaminants for disposal.

According to a different aspect of the invention, apparatus for oil purification comprises a packed column, a steam generator having electrical resistance heating elements which are separately switchable and disposed at different levels in the steam generator, a gravity separator, a coalescer, and condenser all connected together as a unit for carrying out the above mentioned process.

Preferably the steam generator is connected to a three phase electric supply having three separate heating elements, each single phase connected. Preferably each element is arranged generally in a rod like member extending horizontally across the water chamber of the generator, and at different levels in the same, so that when the chamber contains a minimum amount of water only a single element will be immersed and switched for heating, and so on. The switching may be automatic by temperature sensing at the individual heater element or generator water content may be sensed and used to control the heating element switching.

The column may be packed with any convenient random or regular packing, but stacked plate type packing is preferred. Experimentally, the packing made by Sulzer and sold as BX packing has been used successfully.

The gravity separator may be a tank with oil and water discharge outlets at different levels.

The coalescer may be a conventional one and for example one made by Vokes Limited has been used successfully experimentally.

THE DRAWINGS

Figure 1:
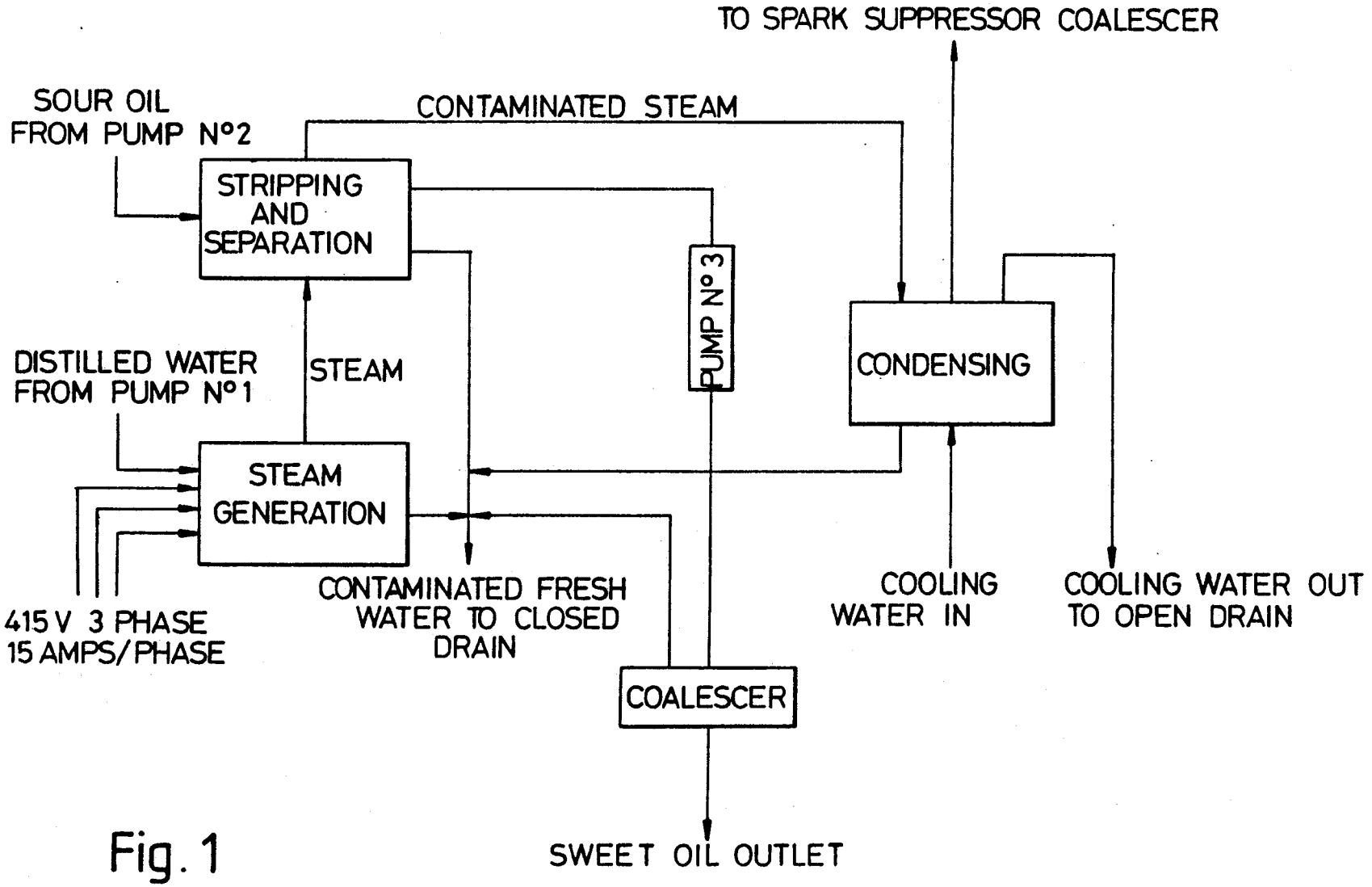
FIG. 1 is a diagram showing the operation.
Figure 2:
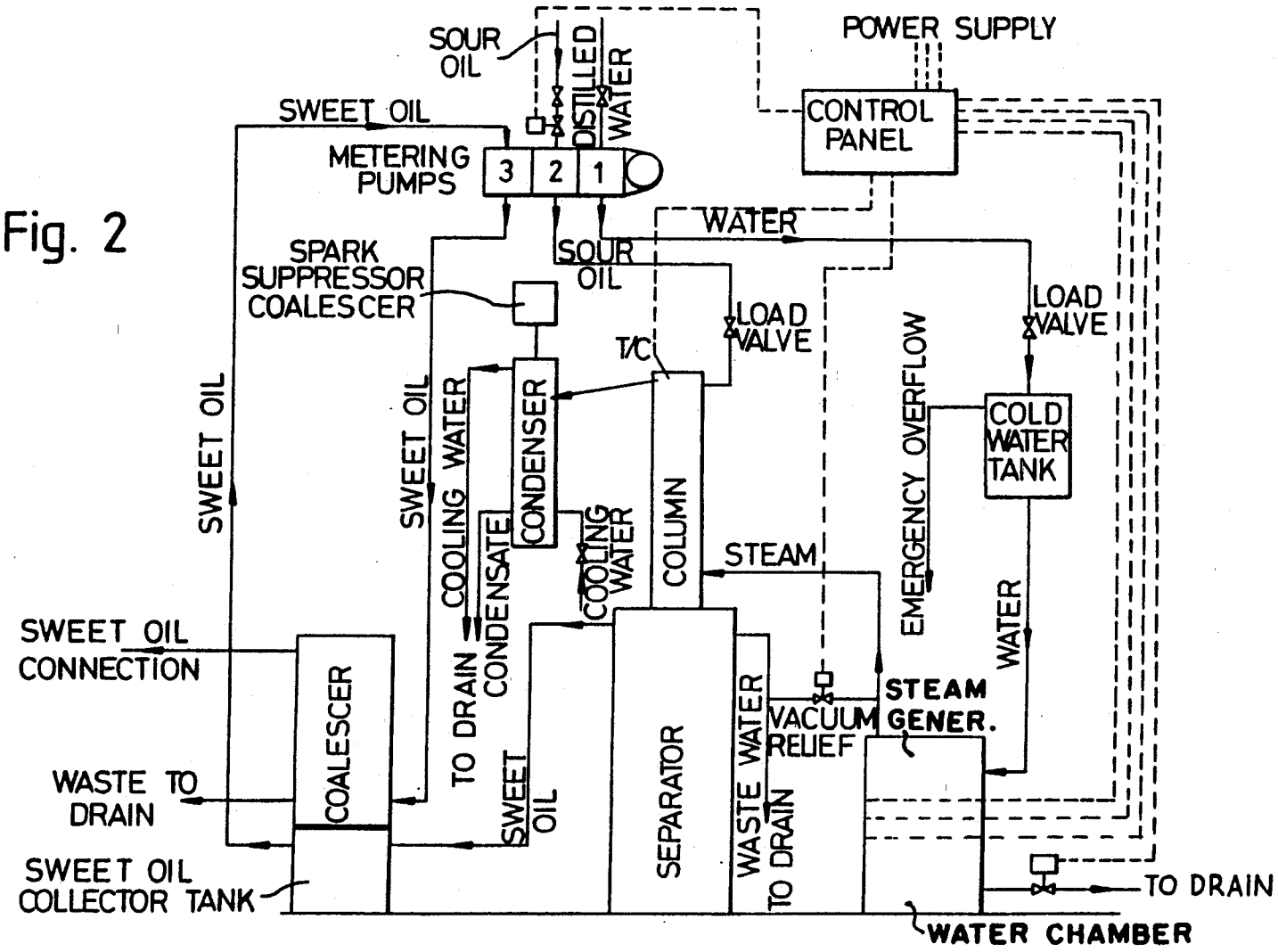
FIG. 2 is a diagrammatic layout of the apparatus.

FIG. 1 is self-explanatory. Turning now to FIG. 2, the apparatus is run until steam at 100° C. is detected at the top of the column, and then the sour oil is pumped by the metering pump No. 2 via the load valve to the top of the packed column where it flows via the packings to the separator. Steam is fed from the generator to the column. The lighter fractions of mixture contain all the contaminants which are to be removed in this purification process pass to the condenser which is supplied with cooling water, and the coolant can be recirculated whilst the contaminants pass to drain for collection and disposal.

The lightest of the contaminants may represent a hazard especially those in gaseous phase, and for this reason a spark suppressor coalescer is disposed above the condenser to collect such fractions, coalesce them into droplets, and return them to the condenser in that coalesced form.

The main bulk of oil mixture descends by gravity to the separator which is below the column, and when the oil due to its lower specific gravity rises to the surface of the mixture, it can be tapped off from the water at different levels.

The sweet oil is passed from the separator via the collector tank and circulated by the pump to pass through a main coalescer before ready for reuse, and the main coalescer serves to restore the sweet oil to a substantially continuous liquid phase free of entrapped vapours and gases.

Having now described our invention what we claim is:

1. Oil purification apparatus comprising an upright column containing packing material, means for introducing oil to said column; steam generator means in communication with said column for supplying steam thereto, said packing material providing extended surface area for contacting oil in said column with steam; a plurality of separately operable heating element in said generator means at different elevation levels for generating said steam; gravity separator means in communication with said column for receiving purified oil therefrom; coalescing means in communication with said separator means for receiving and coalescing oil therefrom; condensing means in communication with said column for receiving and condensing steam therefrom; means for discharging purified, coalesced oil from said coalescing means; and means for discharging waste from said separator.

2. The apparatus according to claim 1 wherein said separately operable heating elements comprise separate electrical heating elements each of which is single phase connected to a three phase electric power supply.

3. The apparatus according to claim 1 wherein said steam generator means has a water chamber and wherein said heating elements extend transversely across said water chamber.

4. The apparatus according to claim 3 wherein each of said heating elements comprises a rod.

5. The apparatus according to claim 3 wherein said water chamber is operable to contain water at different elevation levels, and wherein said heating elements are separately operable according to the level of water in said chamber.

6. The apparatus according to any of the preceding claims wherein said packing material is stacked plate packing.

7. The apparatus according to any of the preceding claims including spark suppressor means above and in communication with said condensing means.

* * * * *